US008584799B1

(12) United States Patent
Dennington

(10) Patent No.: US 8,584,799 B1
(45) Date of Patent: Nov. 19, 2013

(54) FALL-ARRESTING SAFETY HARNESS ASSEMBLY

(76) Inventor: Mark Dennington, Shreveport, LA (US)

( * ) Notice: Subject to any disclaimer, the term of this patent is extended or adjusted under 35 U.S.C. 154(b) by 255 days.

(21) Appl. No.: 13/135,186

(22) Filed: Jun. 28, 2011

(51) Int. Cl.
*A62B 35/00* (2006.01)

(52) U.S. Cl.
USPC ..... 182/3; 182/4; 182/5; 182/6

(58) Field of Classification Search
USPC ..... 182/3, 4, 5, 6
See application file for complete search history.

(56) References Cited

U.S. PATENT DOCUMENTS

| | | | | |
|---|---|---|---|---|
| 3,444,957 | A | 5/1969 | Ervin, Jr. | |
| 3,804,698 | A * | 4/1974 | Kinloch | 428/176 |
| 4,100,996 | A * | 7/1978 | Sharp | 182/3 |
| 4,253,544 | A * | 3/1981 | Dalmaso | 182/3 |
| 4,446,944 | A | 5/1984 | Forrest et al. | |
| 4,538,702 | A | 9/1985 | Wolner | |
| 5,090,503 | A * | 2/1992 | Bell | 182/5 |
| 5,113,981 | A | 5/1992 | Lantz | |
| 5,174,410 | A | 12/1992 | Casebolt | |
| 5,308,101 | A * | 5/1994 | Monty | 280/480.1 |
| 5,316,102 | A * | 5/1994 | Bell | 182/3 |
| 5,487,444 | A | 1/1996 | Dennington | |
| 5,598,900 | A | 2/1997 | O'Rourke | |
| 6,533,066 | B1 | 3/2003 | O'Dell | |
| 6,851,516 | B2 * | 2/2005 | Petzl et al. | 182/3 |
| 7,106,205 | B2 * | 9/2006 | Graef et al. | 340/573.1 |
| 7,392,881 | B1 | 7/2008 | Choate | |
| 7,490,610 | B2 | 2/2009 | Franklin | |
| 7,585,197 | B1 * | 9/2009 | Merten | 441/80 |
| 7,644,986 | B2 | 1/2010 | Berger et al. | |
| 7,677,360 | B2 | 3/2010 | Tanaka et al. | |
| 7,726,350 | B2 * | 6/2010 | Jennings et al. | 139/383 R |
| 8,056,675 | B2 * | 11/2011 | Helms | 182/3 |
| 8,061,479 | B2 * | 11/2011 | Harris, Jr. | 182/3 |
| 8,235,173 | B2 * | 8/2012 | Kopp | 182/6 |
| 8,336,125 | B2 * | 12/2012 | Elders et al. | 2/459 |
| 8,353,386 | B2 * | 1/2013 | Helms | 182/3 |
| 8,360,202 | B1 * | 1/2013 | Woodard | 182/3 |
| 2004/0058598 | A1 * | 3/2004 | Miller | 441/115 |
| 2006/0048723 | A1 * | 3/2006 | Rohlf et al. | 119/857 |
| 2007/0068730 | A1 * | 3/2007 | Griffith | 182/3 |
| 2008/0060872 | A1 * | 3/2008 | Wise | 182/3 |
| 2008/0179136 | A1 * | 7/2008 | Griffith | 182/5 |
| 2012/0067666 | A1 * | 3/2012 | Smith et al. | 182/3 |
| 2012/0222912 | A1 * | 9/2012 | Wood | 182/6 |

* cited by examiner

*Primary Examiner* — Katherine Mitchell
*Assistant Examiner* — Colleen M Chavchavadze
(74) *Attorney, Agent, or Firm* — R. Keith Harrison

(57) ABSTRACT

A fall-arresting safety harness assembly includes a lanyard including a pair of lanyard straps, at least one strap breakaway area attaching the lanyard straps to each other and a strap separation area generally adjacent to the at least one strap breakaway area; a lanyard ring extending between the lanyard straps at the strap separation area of the lanyard; a harness carried by the lanyard; and at least one resilient shock-absorbing member carried by the harness and engaging the lanyard ring.

19 Claims, 6 Drawing Sheets

FALL-ARRESTING SAFETY HARNESS ASSEMBLY

FIELD

The disclosure generally relates to safety harnesses which prevent persons from falling to the ground from elevated structures. More particularly, the disclosure relates to a fall-arresting safety harness assembly which absorbs the energy of a person's falling motion and stops the fall in a non-abrupt manner in the event that the person falls from an elevated structure.

BACKGROUND

Persons who are employed in the construction or maintenance of elevated structures such as buildings, scaffolding, oil rigs, elevated pipelines and the like are frequently at risk of inadvertently falling from the structure. Thus, such persons may be required to wear a safety harness which is designed to prevent the person from falling from the structure. A conventional safety harness used for this purpose may include a harness which is fastened around the torso of the person and a lanyard which attaches the harness to the elevated structure. Accordingly, in the event that the person inadvertently falls from the structure, the harness and lanyard support the person's weight and prevent the person from falling to the ground.

Conventional safety harnesses may be constructed from a tough material such as nylon webbing or leather. The harness may include a "D" ring or other fitting which is secured to one end of the lanyard. The other end of the lanyard may be connected to the elevated structure using a suitable coupling.

Although they may be capable of supporting the weight of a worker in the event that the worker inadvertently falls from an elevated structure, conventional safety harnesses may not have a resilient construction. Therefore, conventional safety harnesses may abruptly stop the falling motion of the worker, subjecting the worker to a sudden and severe jolting impact which may potentially injure the worker.

Accordingly, a fall-arresting safety harness assembly which absorbs the energy of a person's falling motion and stops the fall in a non-abrupt manner in the event that the person falls from an elevated structure is needed.

SUMMARY

The disclosure is generally directed to a fall-arresting safety harness assembly. An illustrative embodiment of the fall-arresting safety harness assembly includes a lanyard including a pair of lanyard straps, at least one strap breakaway area attaching the lanyard straps to each other and a strap separation area generally adjacent to the at least one strap breakaway area; a lanyard ring extending between the lanyard straps at the strap separation area of the lanyard; a harness carried by the lanyard; and at least one resilient shock-absorbing member carried by the harness and engaging the lanyard ring.

BRIEF DESCRIPTION OF THE DRAWINGS

The disclosure will now be made, by way of example, with reference to the accompanying drawings, in which.

DETAILED DESCRIPTION

Figure 1:
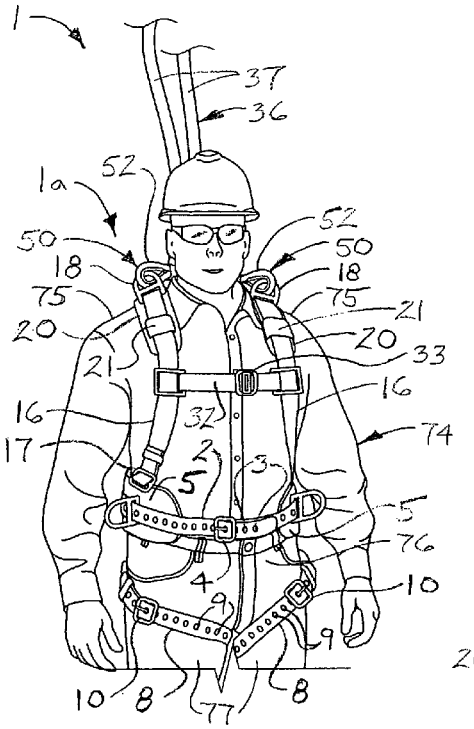
FIG. 1 is a front perspective view of an illustrative embodiment of the fall-arresting safety harness assembly (partially in section), donned by a wearer.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to implement the disclosure and are not intended to limit the scope of the claims. Furthermore, there is no intention to be bound by any expressed or implied theory presented in the preceding technical field, background, brief summary or the following detailed description. Relative terms such as "front", "rear" and the like used herein are for descriptive purposes only and shall not be construed in a limiting sense.

Referring initially to FIGS. 1-8 of the drawings, an illustrative embodiment of the fall-arresting safety harness assembly, hereinafter assembly, is generally indicated by reference numeral 1. The assembly 1 includes a harness 1*a* which is adapted to be fitted around the torso of a wearer 74. In some applications, the wearer 74 may be a construction worker who is involved in the construction and/or maintenance of an elevated structure such as a building, scaffolding, oil rig, elevated pipeline or the like. In other applications, the wearer 74 may be any other person who would otherwise be at risk of falling from an elevated structure or a rock climbing enthusiast who may be at risk of falling from a natural formation such as a mountain, hill or cliff, for example and without limitation.

It will be recognized and understood by those skilled in the art that the description of the harness 1*a* which follows is exemplary only and that a variety of alternative designs for the harness 1*a* are possible. The harness 1*a* of the assembly 1 may include a generally elongated waist belt 2 which is adapted to be fastened around the waist 76 of the wearer 74. The waist belt 2 may include buckle openings 3 and a belt buckle 4 to facilitate circumferential adjustment of the waist belt 2 on the wearer 74 typically in the conventional manner. In some embodiments, a generally elongated, flat back support pad 5 may be provided along the waist belt 2. The back support pad 5 may impart support to the back of the wearer 74 during use of the assembly 1 which will be hereinafter described. The back support pad 5 may be attached to the waist belt 2 using any suitable attachment technique known by those skilled in the art. The back support pad 5 may be attached to the waist belt 2 by extending the waist belt 2 through multiple belt loops 6 provided on the back support pad 5 or in any other suitable manner.

As illustrated in FIG. 1, a pair of generally elongated, parallel, spaced-apart front straps 16 may extend upwardly from the waist belt 2 for extension over the respective shoulders 75 of the wearer 74. A first end of each front strap 16 may terminate in a front strap buckle 17 which is attached to the back support 5 or alternatively, to the waist belt 2. A second end of each front strap 16 may be attached to a corresponding shoulder ring 18. Each shoulder ring 18 may be a conventional D-ring known by those skilled in the art or any other element which is consistent with the functional requirements of the shoulder ring 18. A connecting strap 32 may attach the front straps 16 to each other. The connecting strap 32 may be fitted with a connecting strap adjuster 33 for length adjustment purposes typically in the conventional manner.

As further illustrated in FIG. 1, in some embodiments, a shoulder pad 20 may be fitted beneath each front strap 16 and corresponding shoulder ring 18. Each shoulder pad 20 may be attached to the corresponding front strap 16 by extending the front strap 16 through a strap loop 21 provided on the shoulder pad 20 or in any other suitable manner.

Figure 2:
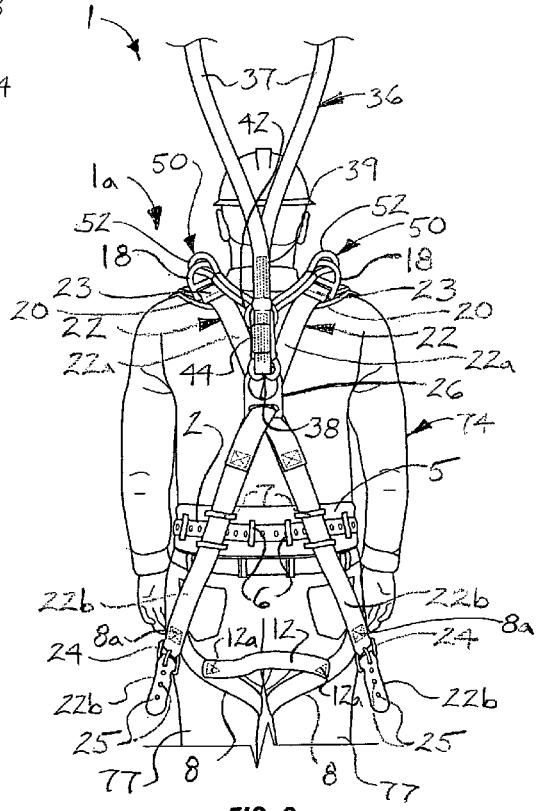
FIG. 2 is a rear view of an illustrative embodiment of the fall-arresting safety harness assembly (partially in section) donned by a wearer.

As illustrated in FIG. 2, a pair of rear straps 22 may be attached to the respective shoulder rings 18. The rear straps 22 may extend downwardly from the shoulder rings 18 in a cross-crossing configuration. Accordingly, each rear strap 22 may include an upper strap segment 22*a* which is attached to the corresponding shoulder ring 18 and a lower strap segment 22*b* which extends from the upper strap segment 22*a*. The rear straps 22 may extend through and intersect each other at a rear ring 26 which divides the lower strap segments 22*b* from the upper strap segments 22*a* of the respective rear straps 22. The rear ring 26 may be a conventional D-ring known by those skilled in the art or any other element which is consistent with the functional requirements of the rear ring 26. In some embodiments, each lower strap segment 22*b* may extend through at least one strap loop 7 provided on the back support pad 5, as illustrated, or alternatively on the waist belt 2. The lower strap segment 22*b* of each rear strap 22 may include a rear strap buckle 24 and buckle openings 25 to adjust the length of each rear strap 22 typically in the conventional manner.

As further illustrated in FIG. 2, a pair of leg straps 8 may be attached to the lower strap segments 22*b* of the respective rear straps 22 such as via stitching 8*a*. The leg straps 8 may be adapted for fastening around and between the legs 77 of the wearer 74. As illustrated in FIG. 1, each leg strap 8 may include buckle openings 9 and a strap buckle 10 for adjustment purposes typically in the conventional manner. As illustrated in FIG. 2, a seat strap 12 may be attached to the leg straps 8, such as via stitching 12*a*, for reinforcement purposes. The waist belt 2 and various other strap elements of the harness 1*a* may be leather, nylon webbing or other strong, durable, flexible material known by those skilled in the art.

A lanyard 36 is attached to the harness 1*a* of the assembly 1. The lanyard 36 may be leather, nylon webbing or other strong, durable, flexible material known by those skilled in the art. In some embodiments, the lanyard 36 may extend through the rear ring 26 of the harness 1*a*, as illustrated in FIGS. 2-6. In some embodiments, the lanyard 36 may have a continuous loop construction and may include a pair of adjacent lanyard straps 37. The lanyard straps 37 may engage the rear ring 26 at a strap loop 38. The lanyard straps 37 of the lanyard 36 may be attached to each other at a strap attachment area 39. Attachment area stitching 40 may attach the lanyard straps 37 to each other at the strap attachment area 39 typically in the conventional manner. The lanyard straps 37 of the lanyard 36 may additionally be attached to each other at at least one strap breakaway area 44. In some embodiments, breakaway area stitching 45 may attach the lanyard straps 37 to each other at the strap breakaway area 44. In other embodiments, alternative attachment techniques known by those skilled in the art may attach the lanyard straps 37 to each other at the strap breakaway area 44. The strap breakaway area 44 may be spaced-apart with respect to the strap attachment area 39 along the length of the lanyard straps 37. A strap separation area 48, in which the lanyard straps 37 remain unattached to each other, may be formed between the strap attachment area 39 and the strap breakaway area 44. A lanyard ring 42 may extend between the lanyard straps 37 at the strap separation area 48 for purposes which will be hereinafter described.

Figure 3:
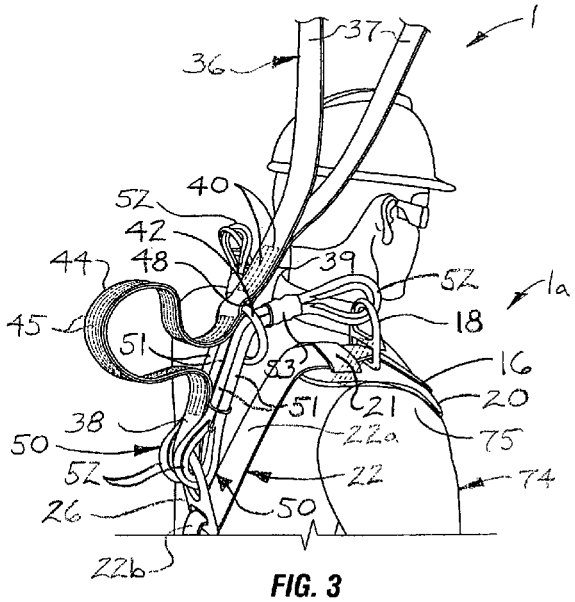
FIG. 3 is a rear perspective view (partially in section) of an illustrative embodiment of the fall-arresting safety harness assembly, with a strap breakaway area on a lanyard of the harness illustrated in a partially-folded configuration.
Figure 4:
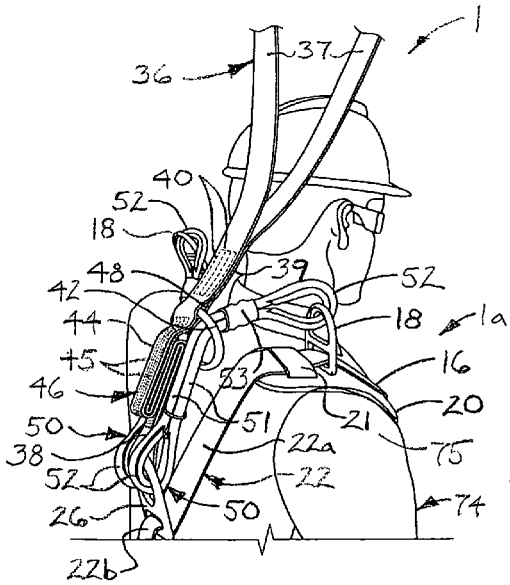
FIG. 4 is a rear perspective view (partially in section) of an illustrative embodiment of the fall-arresting safety harness assembly, with the strap breakaway area on the lanyard of the harness illustrated in a folded, slacked configuration.

The strap breakaway area 44 may extend along a substantial portion of the length of the lanyard 36. Accordingly, when the harness 1*a* is deployed in a non-supporting configuration, as illustrated in FIGS. 3 and 4, the lanyard 36 is slack and the strap breakaway area 44 may be folded upon itself multiple times to form a folded strap portion 46 (FIG. 4).

At least one resilient shock-absorbing member 50 may be attached to the harness 1*a*. In some embodiments, each shock-absorbing member 50 may be attached to a corresponding shoulder ring 18 and the rear ring 26. In some embodiments, a pair of shock-absorbing members 50 may be attached to the respective shoulder rings 18 and the rear ring 26, as illustrated, generally on respective sides of the strap breakaway area 44 of the lanyard 36. Each shock-absorbing member 50 may include a resilient shock-absorbing member cord 51 which may be continuous and forms a pair of opposite-ended cord loops 52. At least one cord bundle sleeve 53 may be provided on the shock-absorbing member cord 51. The cord loops 52 of each shock-absorbing member 50 may be attached to the corresponding shoulder ring 18 and the rear ring 26, respectively.

Each shock-absorbing member 50 engages the lanyard ring 42. In some embodiments, each shock-absorbing member 50 may extend through the lanyard ring 42 in transit between each corresponding shoulder ring 18 and the rear ring 26, as illustrated.

Figure 11:
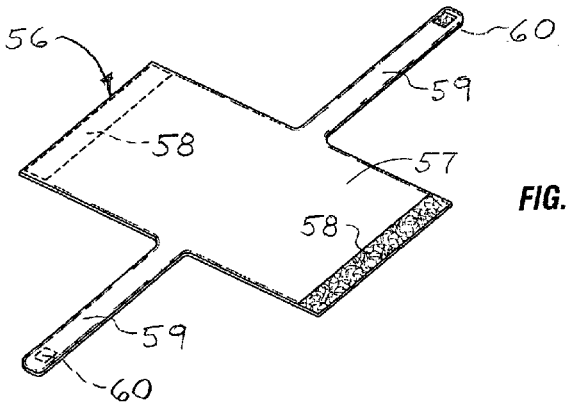
FIG. 11 is a perspective view of a shock-absorbing member cover which is suitable for enclosing a shock-absorbing member of an illustrative embodiment of the fall-arresting safety harness assembly.
Figure 12:
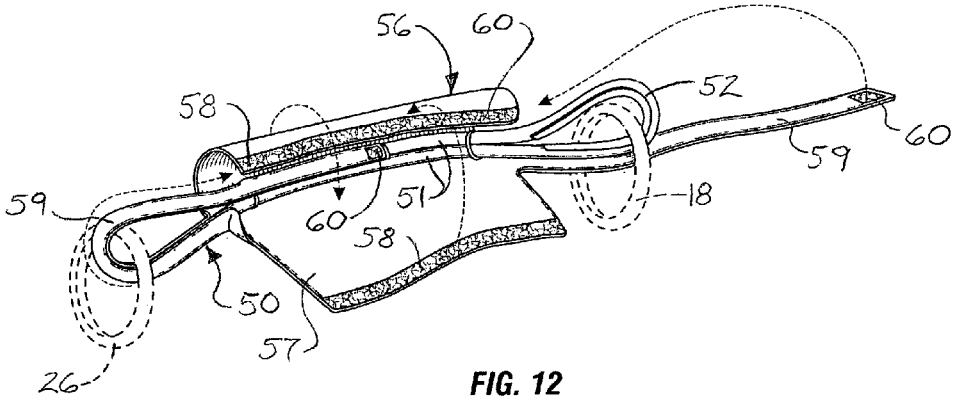
FIG. 12 is a perspective view illustrating exemplary fastening of the shock-absorbing member cover around the shock-absorbing member.
Figure 13:
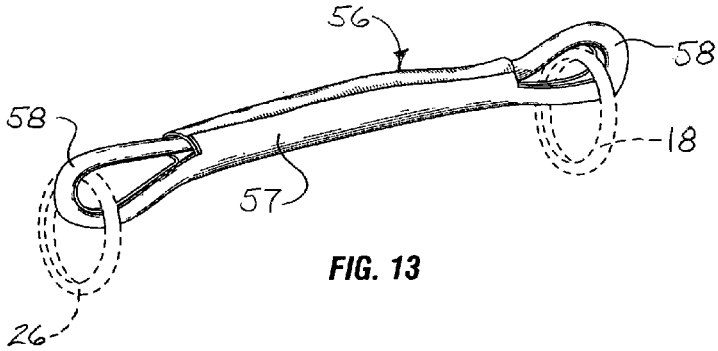
FIG. 13 is a perspective view of the shock-absorbing member cover enclosing the shock-absorbing member.

Referring next to FIGS. 9 and 11-13 of the drawings, in some embodiments, a strap cover 62 (FIG. 9) may at least partially enclose the folded strap portion 46 (FIG. 4) of the lanyard 36 for protective purposes. The strap cover 62 may be polyester or other material. As further illustrated in FIG. 9, a shock-absorbing member cover 56 may at least partially enclose each shock-absorbing member 50. The shock absorbing member cover 56 may have any design which is consistent with the functional requirements of the shock absorbing member cover 56. As illustrated in FIGS. 11-13, in some embodiments, the shock-absorbing member cover 56 may include a generally rectangular cover panel 57. A pair of cover panel fasteners 58, each of which may be a hook and loop or other type of fastener, may be provided along the respective short edges on opposite surfaces of the cover panel 57. A pair of generally elongated cover straps 59 may extend from opposite long edges of the cover panel 57. A cover strap fastener 60, which may be a hook and loop or other type of fastener which is suitable for the purpose, may be provided on each cover strap 59. Accordingly, as illustrated in FIG. 12, each shock-absorbing member cover 56 may enclose the corresponding shock-absorbing member 50 by initially extending or folding the cover straps 59 of the shock-absorbing member cover 56 over and around the respective cord loops 52 of the shock-absorbing member 50. The cover strap fasteners 60 are attached to each other to secure the cover straps 59 in the folded configuration. The cover panel 57 is then wrapped or rolled around the center portion of the shock-absorbing member 50 and the folded cover straps 59 of the shock-absorbing member cover 56, with the cord loops 52 of the shock-absorbing member 50 protruding from opposite ends of the rolled-up cover panel 57. The cover panel fasteners 58 are then attached to each other to secure the cover panel 57 in the wrapped or rolled configuration.

Referring next to FIGS. 5-8 of the drawings, in exemplary application, the assembly 1 prevents a wearer 74 from inadvertently falling from an elevated structure (not illustrated) such as during maintenance or construction, for example and without limitation, of the elevated structure. The harness 1*a* of the assembly 1 is donned by a wearer 74 who takes part in the construction or maintenance of the elevated structure. The harness 1*a* may be donned by the wearer 74 by fastening the waist belt 2 around the wearer's waist 76, extending the shoulder pads 20 over the wearer's shoulders 75 and extending and securing the leg straps 8 around and between the user's legs 77. The waist belt 2 can be selectively adjusted using the belt buckle 4; each front strap 16 can be adjusted using the corresponding front strap buckle 17 (FIG. 1); and each leg strap 8 can be adjusted using the corresponding strap buckle 10 (FIG. 1). The length of the connecting strap connector 32 (FIG. 1) can be selectively adjusted as desired using the connecting strap adjustor 33.

The lanyard 36 is attached to a supporting structural element (not illustrated) of the elevated structure (not illustrated) using bolting and/or any other suitable secure attachment technique which is known by those skilled in the art. In some applications, the lanyard 36 may be extended over the supporting structural element (not illustrated) of the elevated structure and then secured using a suitable securing technique. During construction or maintenance of the elevated structure, the wearer 74 stands or sits on scaffolding (not illustrated) or other support surface beneath the attachment point of the lanyard 36 to the elevated structure. As illustrated in FIG. 4, as the wearer 74 stands or sits on the support surface of the elevated structure, the lanyard 36 may remain in a slack condition and typically does not support the weight of the wearer 74.

Figure 5:
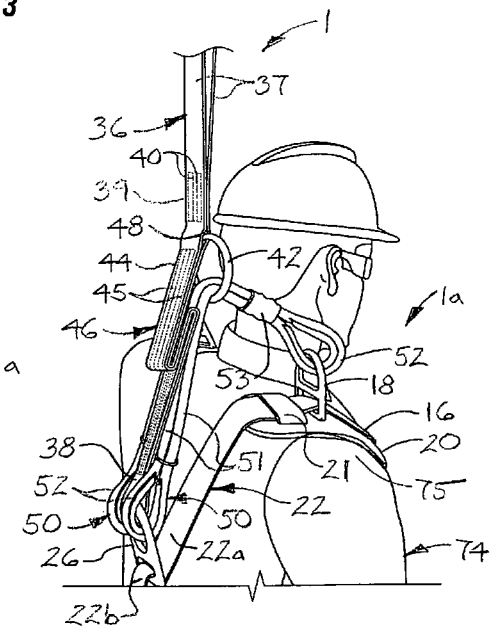
FIG. 5 is a rear perspective view (partially in section) of an illustrative embodiment of the fall-arresting safety harness assembly, with the lanyard and a pair of shock-absorbing members illustrated in a taut, suspending configuration.

As illustrated in FIG. 5, in the event that the wearer 74 inadvertently falls or slips from the support surface on the elevated structure, the lanyard 36 becomes taut and pulls the lanyard ring 42 upwardly against the downward pull of the shock-absorbing members 50. Consequently, the shock-absorbing members 50 absorb the initial fall of the wearer 74 as they are stretched between each corresponding shoulder ring 18 and the rear ring 26 on the harness 1*a*. Therefore, the shock-absorbing members 50 slow the initial descent of the wearer 74 and prevent the harness 1*a* from applying a jolting impact against the wearer 74 during the initial part of the fall.

Figure 6:
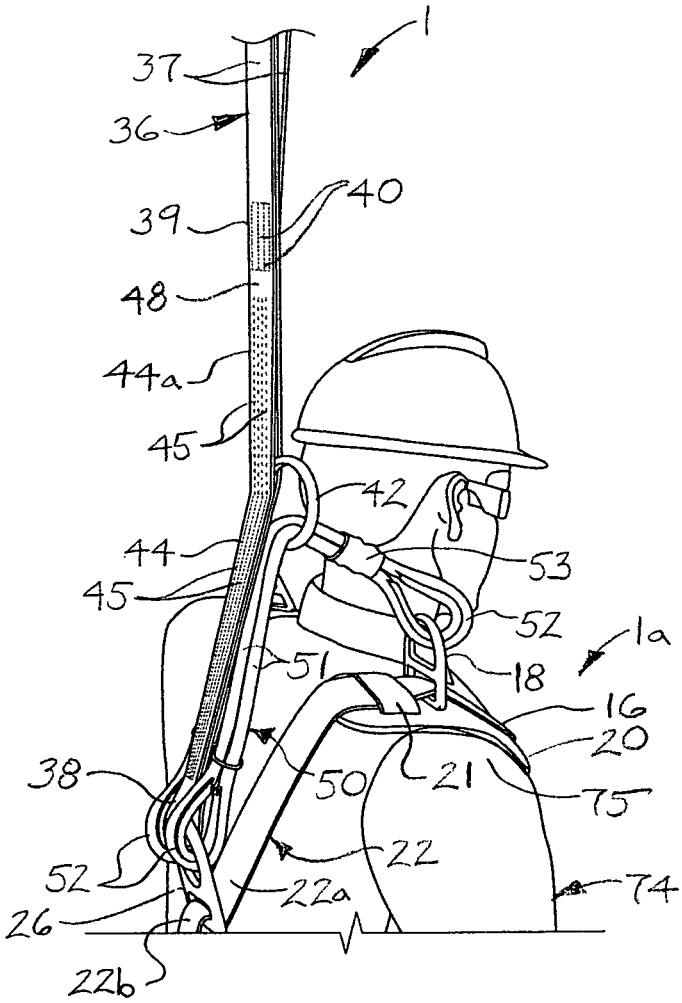
FIG. 6 is a rear perspective view (partially in section) of an illustrative embodiment of the fall-arresting safety harness assembly, with the strap breakaway area on the lanyard of the harness partially torn and forming a ripped stitching area after fall of the wearer from an elevated structure (not illustrated)
Figure 7:
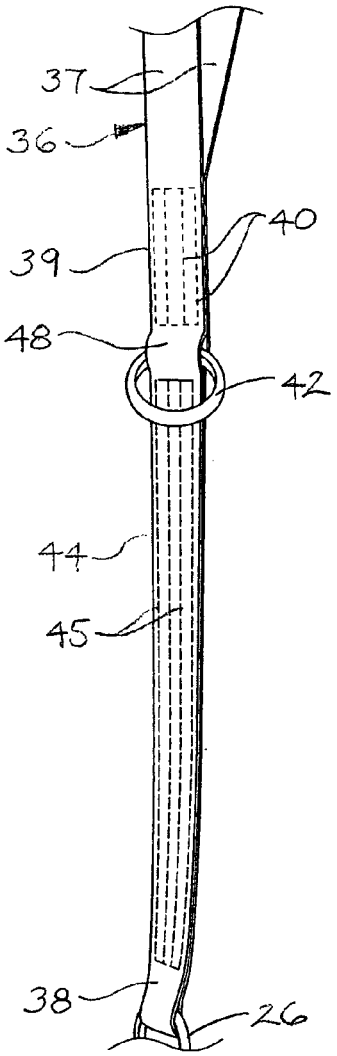
FIG. 7 is a perspective view of the intact lanyard prior to arresting the fall of the wearer.
Figure 8:
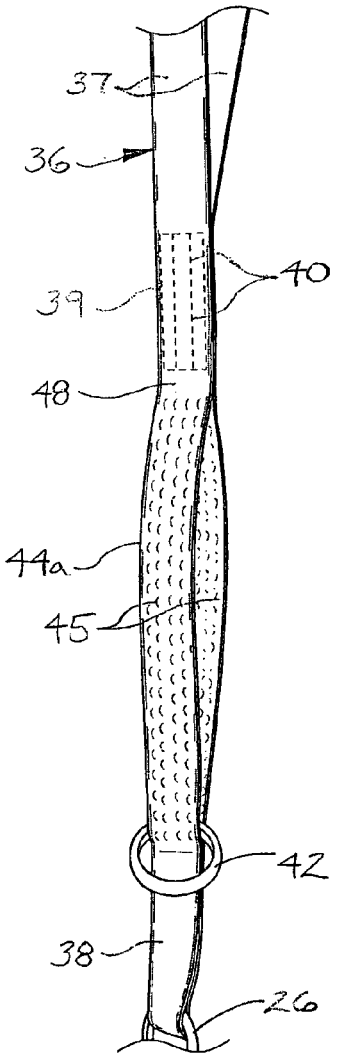
FIG. 8 is a perspective view of the ripped stitching area of the lanyard after arresting the fall of the wearer.
Figure 9:
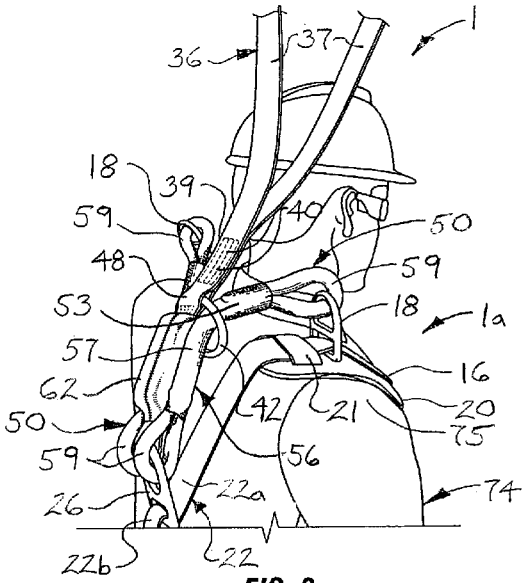
FIG. 9 is a rear perspective view (partially in section) of an illustrative embodiment of the fall-arresting safety harness assembly, with the folded strap breakaway area on the lanyard of the harness contained inside a strap cover.

As the lanyard 36 pulls the lanyard ring 42 upwardly against the shock-absorbing members 50, the shock-absorbing members 50 pull downwardly on the lanyard ring 42. Consequently, as illustrated in FIGS. 6-8, the shock-absorbing members 50 pull the strap ring 42 downwardly from the strap separation area 48 along the strap breakaway area 44. As it travels between the lanyard straps 37 along the strap breakaway area 44 toward the strap loop 38 of the lanyard 36, the lanyard ring 42 tears the breakaway area stitching 45 and forces the lanyard straps 37 away from each other, forming a ripped stitching area 44*a* (FIGS. 6 and 8) along at least a portion of the strap breakaway area 44. The resistance which the breakaway area stitching 45 imparts to the strap ring 42 slows the descent of the strap ring 42 along the strap breakaway area 44. In some applications, the strap ring 42 may stop before tearing the entire length of the strap breakaway area 44 such that the lanyard 36 supports the wearer 74 until rescue operations can commence. In the event that the strap ring 42 tears the entire length of the strap breakaway area 44 to the strap loop 38, as illustrated in FIG. 8, the lanyard 36 remains intact and supports the wearer 74 above the ground. In either case, the shock-absorbing members 50 remain intact and additionally support the wearer 74 until the wearer 74 is rescued.

Figure 10:
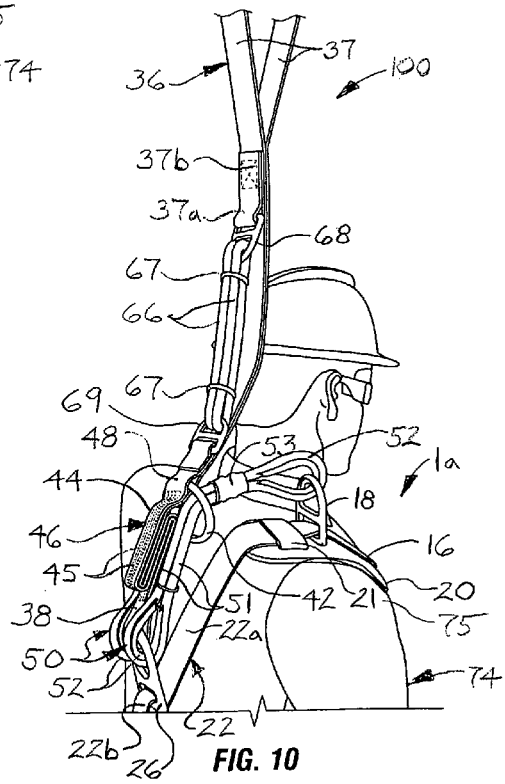
FIG. 10 is a rear perspective view (partially in section) of an alternative illustrative embodiment of the fall-arresting safety harness assembly, with a pair of energy-absorbing suspension bands fitted on the lanyard to enhance the fall-arresting capacity of the lanyard.

Referring next to FIG. 10 of the drawings, an alternative illustrative embodiment of the fall-arresting safety harness assembly is generally indicated by reference numeral 100. The assembly 100 may have a design which is similar to that of the assembly 1 which was heretofore described, as like numbers represent like elements between the embodiments. The assembly 100 may include at least one and typically a pair of resilient suspension bands 66 which are attached to one of the lanyard straps 37 of the lanyard 36 according to any suitable technique known by those skilled in the art. In some embodiments, a strap loop 37*a* may be attached to the lanyard strap 37 via stitching 37*b*. Each suspension band 66 may extend through an upper suspension band ring 68 which is attached to the strap loop 37*a*. Each suspension band 66 may also extend through a lower suspension band ring 69 which is attached to the lanyard 36 just above the strap separation area 48 thereof. Each suspension band 66 may be bound by a pair of suspension band loops 67.

In exemplary application, the safety harness assembly 100 may be used as was heretofore described with respect to the safety harness assembly 1. In the event that the wearer 74 inadvertently falls from an elevated structure, the shock-absorbing members 50 and the strap breakaway area 44 of the lanyard 36 absorb the energy from the wearer's falling motion and arrest the fall of the wearer 74 as was heretofore described with respect to the safety harness assembly 1. Additionally, the suspension bands 66 further absorb or cushion the initial fall of the wearer 74 as the safety harness assembly 100 supports the wearer 74 above the ground.

While the illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A fall-arresting safety harness assembly, comprising:

a lanyard including a pair of lanyard straps, at least one strap breakaway area attaching said lanyard straps to each other and a strap separation area generally adjacent to said at least one strap breakaway area;

a lanyard ring extending between said lanyard straps at said strap separation area of said lanyard;

a harness carried by said lanyard; and a pair of generally resilient shock-absorbing members carried by said harness and engaging said lanyard ring generally on respective sides of said strap separation area of said lanyard.

2. The assembly of claim 1 wherein each of said shock-absorbing members comprises a resilient shock-absorbing member cord and a pair of opposite cord loops formed in said shock-absorbing member cord and attached to said harness.

3. The assembly of claim 2 further comprising a plurality of rings carried by said harness and wherein said cord loops of each said shock-absorbing member engage said plurality of rings, respectively.

4. The assembly of claim 1 further comprising a strap attachment area attaching said lanyard straps to each other and wherein said strap separation area is between said strap attachment area and said at least one strap breakaway area.

5. The assembly of claim 1 wherein said pair of resilient shock-absorbing members extends through said lanyard ring.

6. The assembly of claim 1 further comprising breakaway area stitching attaching said lanyard straps to each other at said at least one strap breakaway area.

7. The assembly of claim 1 wherein said at least one strap breakaway area is folded to form a folded strap portion in said lanyard.

8. A fall-arresting safety harness assembly, comprising:

a harness;

a pair of shoulder rings carried by said harness;

a rear ring carried by said harness;

a lanyard including a pair of lanyard straps having a strap loop engaging said rear ring, at least one strap breakaway area attaching said lanyard straps to each other and a strap separation area generally adjacent to said at least one strap breakaway area;

a lanyard ring extending between said lanyard straps at said strap separation area of said lanyard; and a pair of resilient shock-absorbing members carried by said shoulder rings, respectively, and said rear ring and engaging said lanyard ring.

9. The assembly of claim 8 wherein each of said shock-absorbing members comprises a resilient shock-absorbing member cord and a first cord loop formed in said shock-absorbing member cord and engaging a corresponding one of said shoulder rings and a second cord loop formed in said shock-absorbing member cord and engaging said rear ring.

10. The assembly of claim 8 further comprising a strap attachment area attaching said lanyard straps to each other and wherein said strap separation area is between said strap attachment area and said at least one strap breakaway area.

11. The assembly of claim 8 wherein said resilient shock-absorbing members extend through said lanyard ring.

12. The assembly of claim 8 further comprising breakaway area stitching attaching said lanyard straps to each other at said at least one strap breakaway area.

13. The assembly of claim 8 wherein said at least one strap breakaway area is folded to form a folded strap portion in said lanyard.

14. The assembly of claim 13 further comprising a strap cover generally enclosing said folded strap portion of said lanyard.

15. The assembly of claim 8 further comprising a shock-absorbing member cover generally enclosing each of said shock-absorbing members.

16. A fall-arresting safety harness assembly, comprising:

a lanyard including a pair of lanyard straps, at least one suspension band carried by said lanyard straps, a strap separation area in said lanyard and at least one strap breakaway area attaching said lanyard straps to each other generally adjacent to said at least one strap separation area;

a lanyard ring extending between said lanyard straps at said strap separation area of said lanyard;

a harness carried by said lanyard; and a pair of generally resilient shock-absorbing members carried by said harness and engaging said lanyard ring generally on respective sides of said strap separation area of said lanyard.

17. The assembly of claim 16 wherein said at pair of generally resilient shock-absorbing members extends through said lanyard ring.

18. The assembly of claim 16 further comprising breakaway area stitching attaching said lanyard straps to each other at said at least one strap breakaway area.

19. The assembly of claim 16 wherein said at least one strap breakaway area is folded to form a folded strap portion in said lanyard.

* * * * *